United States Patent [19]

Knox, Jr. et al.

[11] Patent Number: 4,813,617

[45] Date of Patent: Mar. 21, 1989

[54] WET GRINDING MACHINE

[76] Inventors: Arthur C. Knox, Jr.; Anthony Witsken, both of 525 Purcell Ave., Cincinnati, Ohio 45205

[21] Appl. No.: 208,375

[22] Filed: Jun. 17, 1988

[51] Int. Cl.[4] ..... B02C 23/36

[52] U.S. Cl. ..... 241/46.06; 241/33; 241/74; 241/80

[58] Field of Search ..... 241/33, 46.02, 46.06, 241/46.08, 46.11, 46.15, 46.17, 62, 74, 80, 95, 97, 84.2, 86.1, 88.4, 46.13; 366/302–307; 415/121 B

[56] References Cited

U.S. PATENT DOCUMENTS

| | | | |
|---|---|---|---|
| 4,096,057 | 6/1978 | Porritt et al. | 241/74 X |
| 4,570,863 | 2/1986 | Knox, Jr. et al. | 241/46.06 X |
| 4,637,555 | 1/1987 | Furichi et al. | 241/46.06 X |

*Primary Examiner*—Timothy V. Eley
*Attorney, Agent, or Firm*—James W. Pearce; Roy F. Schaeperklaus

[57] ABSTRACT

A wet grinding machine which includes a grinder head, an annular stator having a mounting portion mounted on the grinder head and joined by a body portion to a skirt portion, and a rotor rotatably mounted on the grinder head. The rotor includes a hub portion joined by an annular body portion to an annular skirt portion inside of the annular stator. Outwardly extending slots in the body portion of the rotor define shearing blades in the body portion. Outwardly extending shearing slots in the body portion of the stator are opposed to the shearing blades. Each of the shearing slots slopes and overlaps at least one adjacent shearing blade. As the rotor turns, each of the blades is constantly opposed to and addresses at least one of the shearing slots. There are inlet openings in the stator skirt and in the rotor skirt. The rotor is turned to cause the rotor blades to induce a slurry to flow through the inlet openings of the stator skirt and rotor skirt and rotor body to the shearing slots and to shear particles of slurry entering the shearing slots. The stator skirt being extendable to receive slurry to be ground at a desired location spaced from the grinder head, and an eductor for adding material to the slurry moving through the rotor skirt so the material is substantially evenly mixed in the slurry exiting from the grinder head.

41 Claims, 4 Drawing Sheets

FIG. 3
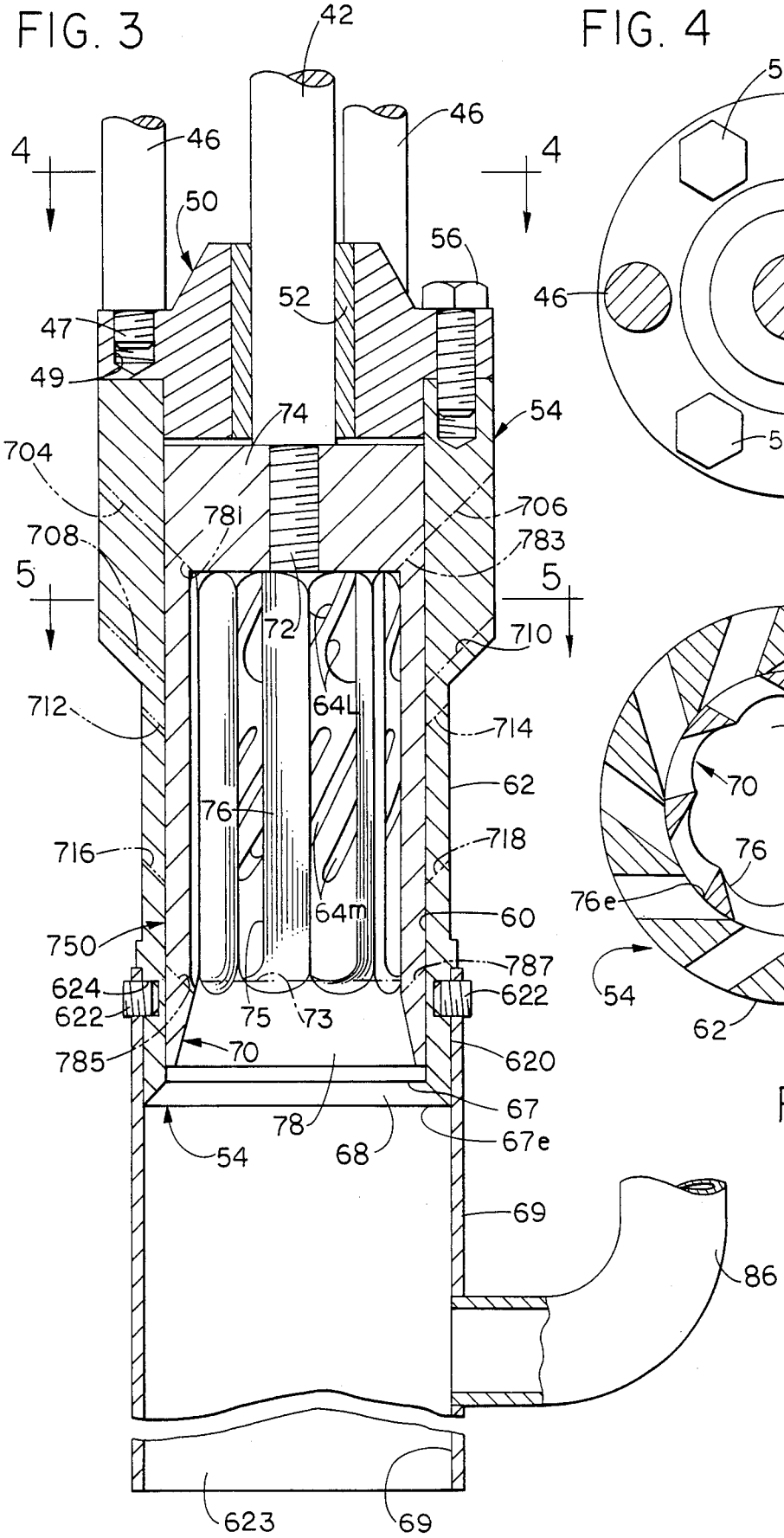
FIG. 4
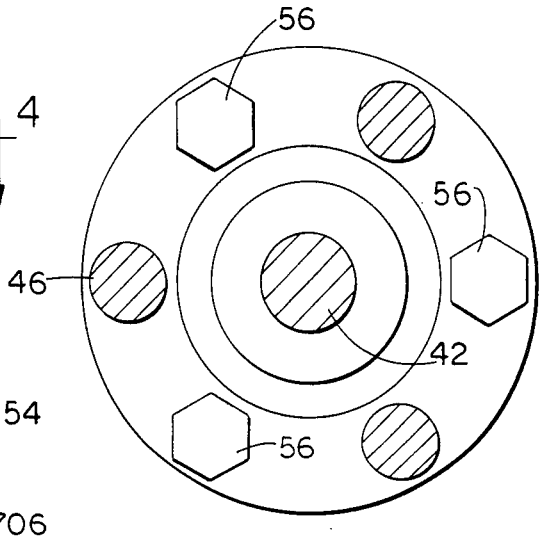
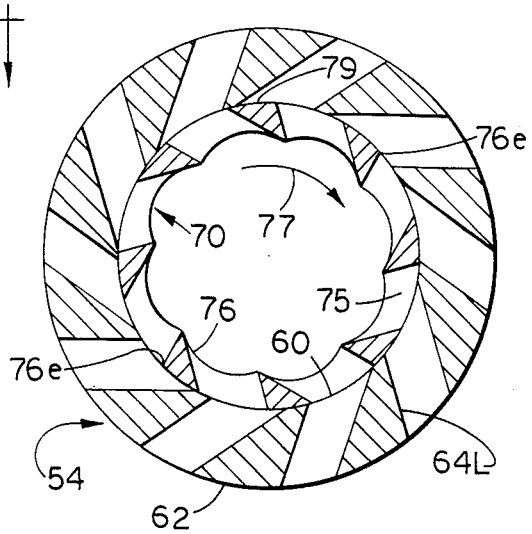
FIG. 5

WET GRINDING MACHINE

BACKGROUND OF THE INVENTION

This invention relates to a device for continuous grinding of solids in a liquid. The device of this application represents an improvement over the device shown and claimed in U.S. Pat. No. 4,570,863 issued Feb. 18, 1986.

An object of this invention is to provide a device which can grind agricultural products, such as whole grain, corn, rice or the like, bean, nuts, rubber billets or other solids as required in producing a mash or slurry, emulsion, dispersion of solids into suspension, or a solution containing dissolved or solvated solids in preparation for further processes such as liquidification for the fermentation industries.

Another object of this invention is to provide a device which can grind solids in a liquid to form slurries, dispersions or emulsions of all or a portion of the solids, to disperse solids into suspension and to dissolve or solvate the soluble portion of solids in liquid.

A further object of this invention is to provide a device which can grind solids in a liquid to form emulsions, slurries of the solids, disperse solids into suspension, dissolve or solvate soluble portions of solids in liquid and disperse additives in such liquid to provide either an end product or prepared feed stock for further steps in processes wherein such feed stocks are utilized.

BRIEF SUMMARY OF THE INVENTION

Briefly, this invention provides a wet grinding machine which includes a grinder head, an annular stator mounted on and extending downwardly from the grinder head, and a rotor rotatable in cooperating relation to the stator and mounted on a drive shaft journalled in the grinder head, all constituting a grinding assembly which can be supported with the stator thereof inside a vessel. The rotor includes evenly spaced upright shearing bars defining rotor slots between them and turns inside the stator. A central portion of the rotor is hollow and has a skirted open mouth at one end to facilitate flow of slurry-to-be-ground into the hollow of the rotor. The cross-sectional area of the hollow of the rotor is greatest at the mouth end of the skirt and decreases toward the adjacent rotor slot ends. The shearing bars of the rotor have an edge adjacent the hollow and a radial extent substantially equal to the radial extent of the adjacent portions of the skirt. Since the radial extent of the bars is like that of the adjacent part of the skirt, the bars do not present a surface axially obstructing axial flow of fluid into the hollow central portion of the rotor through the skirted mouth. Wherefore, the number of bars and slots may be varied without altering the cross-sectional area of the inlet to the hollow of the rotor; that is, the surfaces of the blades being located outwardly of the hollow, do not oppose the axial flow of fluid slurry into the hollow central portion of the rotor. The rotor slots between the shearing bars terminate short of and in spaced relation to the ends of the rotor and are directed trailingly outwardly relative to a radius from the axis of rotation of the rotor through the central portion of the slot in a plane perpendicular to the axis of rotor rotation; that is, the inner ends of the rotor slots are ahead of the outer ends of the respective slots when the rotor rotates in a given direction. Of course, upon reverse rotation of the rotor, the outer ends of the rotor slots are ahead of the inner ends of the respective slots and would in such case be fairly characterized as having outward ends leading relative to a radius as opposed to trailing outwardly due to the opposite character of rotation. Each of the shearing slots in the stator slopes (is not parallel to the stator axis) and overlaps adjacent shearing slots in the stator so that each of the rotor bars is constantly addressing at least one of the shearing slots in the stator. The intercepts of the shearing slots of the stator in a plane perpendicular to the axis of the rotor rotation are canted outwardly and to one side of a radius through the stator slot and the adjacent rotor slot, while the adjacent rotor slot between shearing bars of the rotor is canted outwardly to the second (opposite) side of the radius through the slots. The stator extends downwardly from the shearing slots to an inlet opening spaced from the shearing slots. The rotor is turned to cause the rotor bars to provide a pumping action to induce a slurry to enter the inlet opening in the stator and move through the stator to and through the rotor inlet opening into the hollow central portion of the rotor from which it is centrifically discharged through the shearing slots. Rotation of the rotor in a direction in which the slots between the shearing bars of the rotor move such that flow through those slots is trailingly radially outward results in movement of slurry from the grinder head upwardly and outwardly in the body of slurry outwardly of the grinder head to produce currents of one character,w hile rotation of the rotor in an opposite direction produces currents in the slurry outwardly of the head having more outward and downward (less upward) paths in the body of slurry outwardly of the grinder head.

Thus, rotation of the rotor in one direction can produce currents tending to more strongly agitate the portion of the slurry adjacent its upper surface to draw particulate matter floating on the upper surface of the body of slurry into the slurry in which the grinder head is immersed for mixing such floating materials into the slurry, while rotation of the rotor in an opposite direction produces substantially like volumetric flows through the grinder and in the body of the slurry to produce stronger mixing currents in the body of the slurry by reducing the dissipation of mixing current forces which is incident to the stronger agitation of the portions of slurry near the upper surface thereof incident to the opposite rotation.

The stator may be provided with a suction tube or skirt so as to effectively locate the inlet to the stator at such distance and location beyond the mouth of the rotor as may be desired so that inflow to the grinder rotor mouth may be drawn from a particular location other than the location of the grinder in the vessel in which the grinder is disposed.

Further, the tubular extension of the stator may be provided with a radial inlet or eductor port between the inlet to the suction tube and the mouth of the rotor so that fluid additive(s) may be introduced into and be mixed in the slurry passing through the tube to the rotor of the grinder to effect preliminary mixing of such added fluid(s) in the slurry during movement through the tube followed by supplemental more violent mixing incident to traverse of the mixture through the grinder rotor and stator followed by mixing through discharge into the larger volume of slurry in the vessel in which the grinder is disposed.

Further, the grinder may be placed in a classifier or screen which is in turn received in a fluid holding vessel. The fluid externally of the classifier is in communication with fluid internally of the classifier only through classifying openings in the classifier such that particulates to be ground may be added through the top of the classifier to the fluid therein and ground by the grinder to form a slurry, while liquid or gaseous materials may be fed through the eductor into slurry in the feed tube of the grinder for efficient mixing and grinding to form a substantially uniform slurry mixture that is ground and re-ground until it escapes through the classifier in the form of fluid and particles which will pass therethrough. If desired, particulates to be ground may be entrained in liquid and/or gaseous feed material to be ground and the resultant fluid fed through the eductor into slurry in the suction tube of the grinder.

A further object of the invention is to provide a grinder which substantially grinds particulate particles having a minor dimension about equal to or less than the greatest stator slot width and above a particle size related to the width of the narrowest stator slot, to particles having a desired minor dimension less than the width of the narrowest stator slot.

A further object of the invention is to provide a multistage grinding system in which slurry from one stage is transferred and introduced through the eductor of the grinder in a second stage in which the classifier retains the slurry particles until ground to a predetermined greater degree of fineness of particles to prepare slurries or other mixtures for processing or other uses.

The above and other objects and features of the invention will be apparent to those skilled in the art to which this invention pertains from the following detailed description and the drawings, in which:

BRIEF DESCRIPTION OF THE DRAWINGS

FIG. 3 is a fragmentary view in upright section of the machine, portions of stator slots being shown in full lines and conic loci containing upper and lowre ends of the stator slots and conic loci containing upper and lower ends of rotor slots being indicated in dot-dash lines;

FIG. 4 is a view in section taken on the line 4-4 in FIG. 3;

FIG. 5 is a view in section taken generally on the line 5—5 in FIG. 3;

DESCRIPTION OF THE PRESENTLY PREFERRED EMBODIMENT

Figure 1:
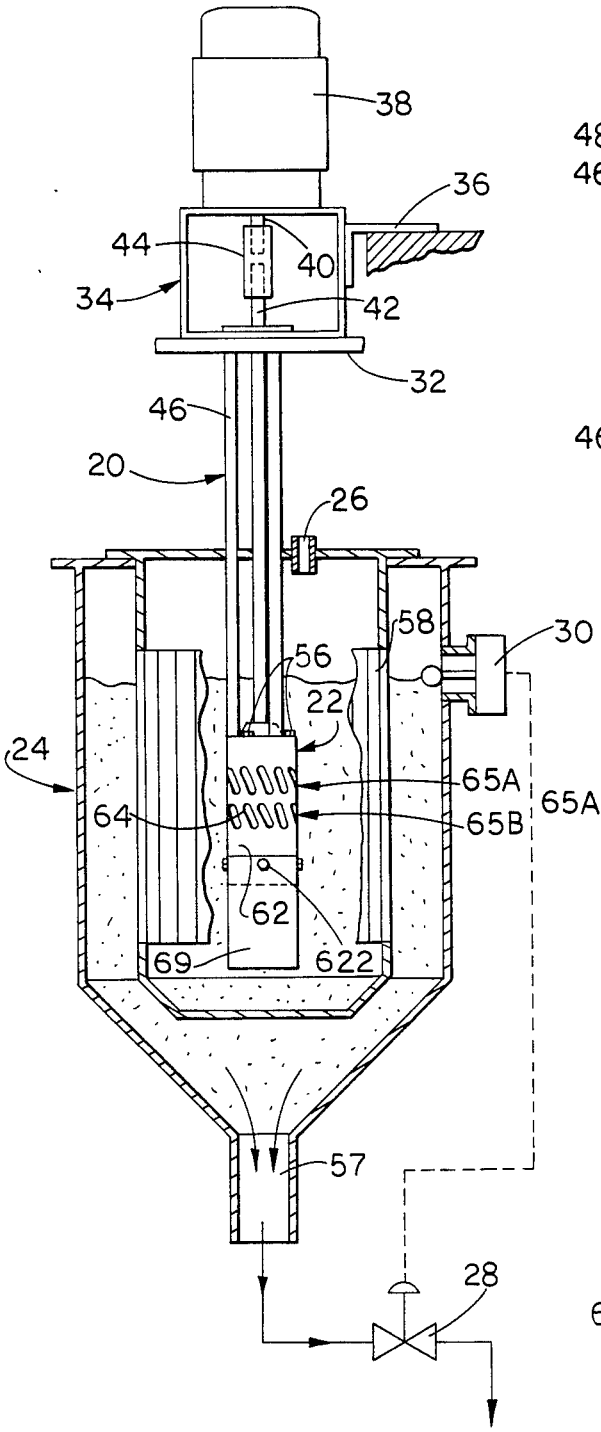
FIG. 1 is a somewhat schematic view in transverse section of a machine for continuous grinding of particulate material, which is constructed in accordance with an embodiment of this invention.

In the following detailed description and the drawings, like reference characters indicate like parts.

In FIG. 1 is shown a wet grinding machine 20 constructed in accordance with an embodiment of this invention. The machine 20 includes a grinding assembly 22 and a chamber or vessel 24 surrounding the grinding assembly 22. Associated therewith are an outlet valve 28 and a liquid level controller 30, which are shown diagrammatically.

The grinding assembly 22 includes a base plate 32 on which a support cage 34 is mounted. The cage 34 is supported on an appropriate support 36, not shown in detail. A motor 38 is supported on the cage 34. The motor drives a shaft 40, which is coupled to a main drive shaft 42 by a coupling 44.

Three support rods 46 are mounted in sockets 48 in the base plate 32. Fasteners 45 attach the support rods 46 to the base plate 32. Lower end portions 47 of the rods 46 are threaded in sockets 49 (FIG. 3) in a grinder head 50 to support the grinder head 50 so that the grinder head 50 is supported by the rods 46, the base plate 32 and the cage 34. The main drive shaft 42 extends through a bearing 52 mounted in the grinder head 50.

Figure 2:
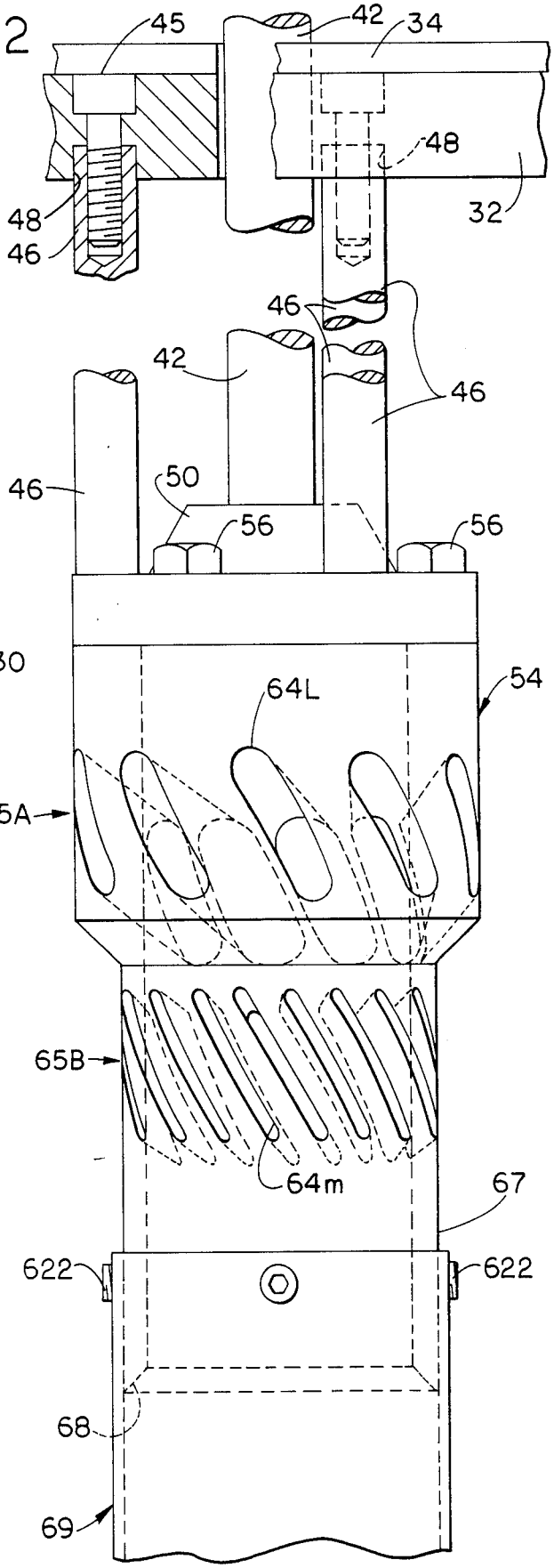
FIG. 2 is a fragmentary view in side elevation on an enlarged scale of a grinding head and of a support portion of the machine, part of the support portion being broken away to show details of construction.
Figure 6:
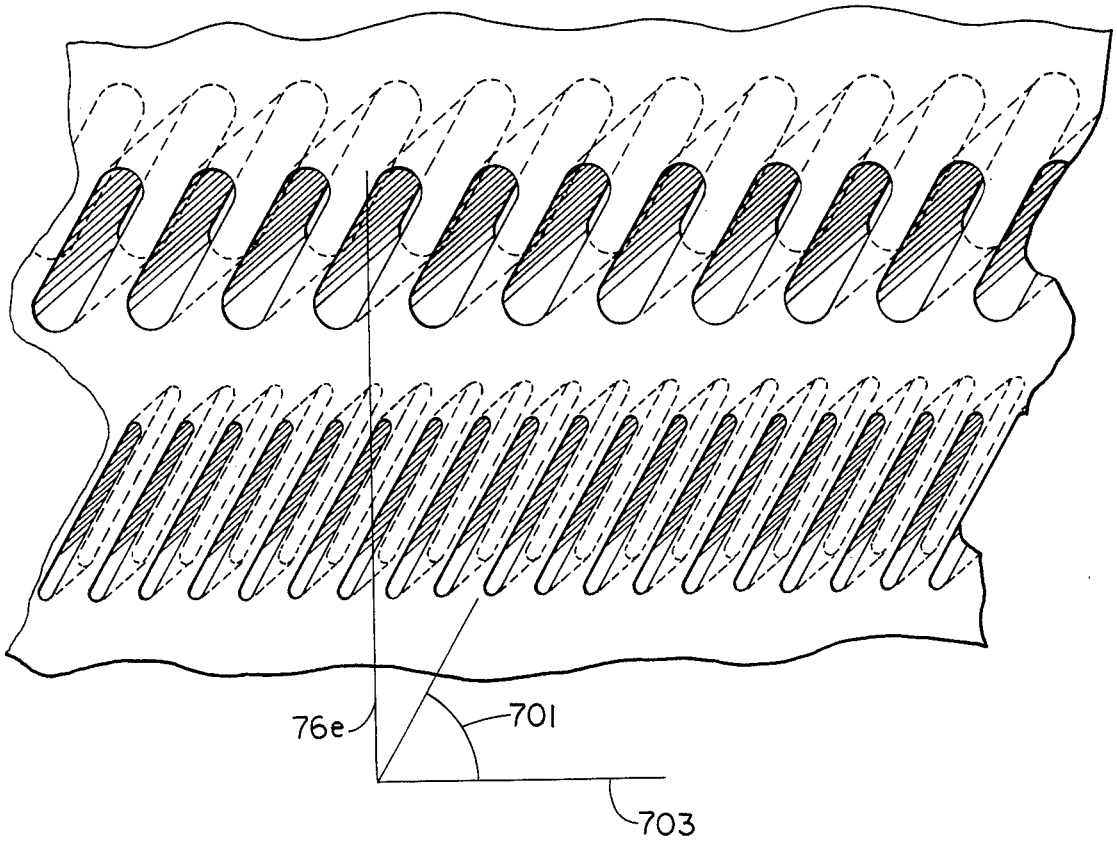
FIG. 6 is a developed view showing inner ends of stator slots of the machine in full line.
Figure 7:
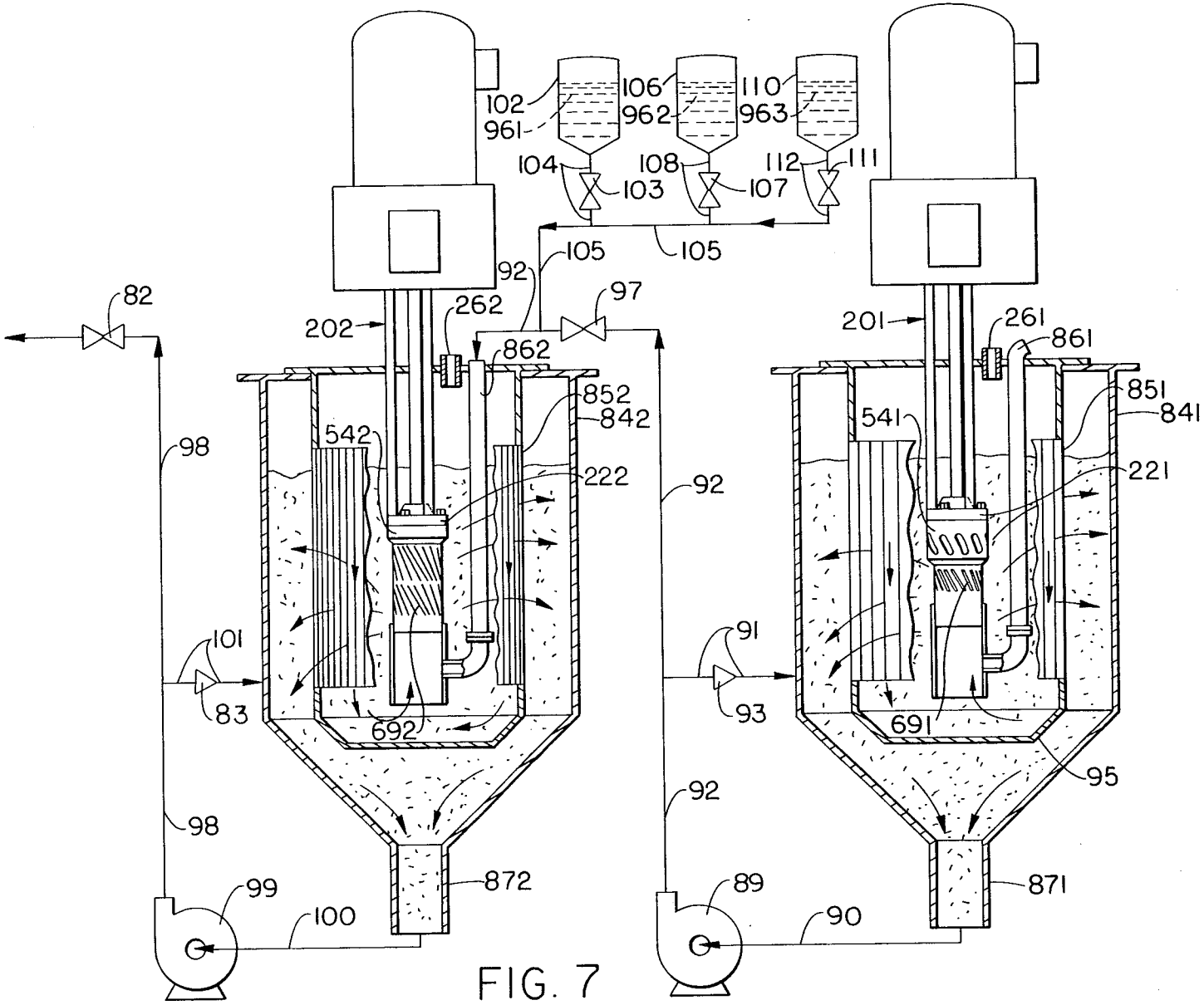
FIG. 7 is a generally schematic view of a multi-stage grinding system constructed in accordance with an embodiment of this invention.

An annular stator member or shroud 54 is mounted on the grinder head 50 by means of bolts 56. The stator 54 has a generally cylindrical inner face 60 and a cylindrical outer face 62 as shown in FIG. 1, or an outer face having a plurality of cylindrical portions as shown in FIGS. 2, 3 and 7. Slots 64 are provided in the stator member 54. The slots 64 are arranged around the axis of the stator member 54 in rows 65A and 65B and intersect the inner face 60 and the outer face 62. The slots 64 are shown evenly spaced in and of one size in each row (but as shown in FIG. 7 may be of different sizes in different rows as in machine 201, or the same size as in machine 202), and extend generally outwardly from the inner face 60 in a direction extending upwardly, circumferentially and radially as shown in FIGS. 2, 5 and 6. A lower portion 67 of the stator member 54 includes a lower inner face portion 68 which slopes downwardly and outwardly. The outer face 62 of the shroud 54 is cylindrical. A shoulder of reduced diameter having a cylindrical outer face 620 is provided adjacent the lower end of the shroud 54 shown in FIG>3 to receive an upper end portion of a stator skirt or suction tube 69. Fasteners 622 hold the skirt 69 in position. The fasteners 622 are received in radial threaded bores 624 in the shroud 54. An inlet opening 623 (FIG. 3) for the stator is provided at the lower end of the skirt 69. An eductor tube 86, as shown in FIG. 3, provides means for charging material to be ground directly into the intake of the grinding assembly 22.

As shown in FIGS. 3 and 5, each of the slots 64L extends outwardly at an angle of approximately 60 degrees to a radius from the axis of the stator in the plane of FIG. 5 and upwardly at an angle 701 (FIG. 6) of approximately 60 degrees to a plane 703 (FIG. 6) of the stator 54 which is perpendicular to the axis thereof. In FIG. 3 are shown dot-dash lines 704–706 which define a cone in which upper ends of the slots in the row 65A are approximately located. Dot-dash lines 708–710 define a cone in which lower edges of the slots in the row 65A are approximately located. Dot-dash lines 712–714 define a cone in which upper edges of the slots in the row 65B are approximately located. Dot-dash lines 716–718 define a cone in which lower ends of the slots in the row 65B are approximately located. The dot-dash lines 704–706, 708–710, 712–714 and 716–718 in the illustrative drawings extend at like angle to the axis of the stator 54.

A rotor 70 is mounted on an axial stud portion 72 of the main drive shaft 42. The rotor includes an upper head portion 74 and a hollow cylindrical portion 750 provided with upright slots 75 to form blades 76. Lower end portions of the blades are connected by a web 78. In FIG. 3, dot-dash lines 781–783 define a cone in which upper ends of the slots 75 approximately fall, and which is aligned with cone 704–706 containing the upper ends of stator slots 64 in row 65A. Dot-dash lines 785–787 define a cone in which lower ends of the slots 75 approximately fall. The blades 76 sweep not only the slotted portion of the inner face 60 of the stator 54, but the unslotted portion of face 60 between the lower ends of slots 64m, the line where the cone 716–718 intercewpts face 60, and the dot-dash line 73 which coincides with the lower ends of rotor slots 75. In forward rotation, the rotor 70 turns in the direction of an arrow 77 in FIG. 5. Outer edge faces 79 of the blades 76 sweep across inner ends of the slots 64L in closely spaced shearing relation to the inner face 60 of the stator 54 to shear solid particles as the solid particles enter the slots 64L. The blades 76 are approximately upright as shown in FIGS. 3, 5 and 6. As the rotor 70 turns, the baldes 76 sweep across the inner ends of the slots 64 with each blade 76 intersecting at least one slot 64 at all times so that there is a continuous shearing action between the leading edge **76*e* of each blade 76 and the opposed inner shear edge of the stator slot or slots opposed to the blade. The interior of the rotor 70 inside the blades 76 is hollow to provide a space through which a slurry can flow from the hollow interior of the skirt 69 to the slots 75**.

The extension of the stator and rotor below the bottom ends of the slots **64*m* alters and enhances the characteristics of the fluid flow through the slots 64*m*. Where the bottom edge of the stator is substantially at the bottom ends of the slots 64, the outward flow through those slots is strong adjacent their upper ends and may even be supplanted by an inward flow of eddy-like character adjacent the bottom ends. Lengthening the stator to provide an unslotted portion extending downwardly from the bottoms of slots 64*m* to the edge 67*e* adjacent lower innerface 68 results in increased outward flow through the length of the slots 64*m*. Further, the extension of the slots 75 in the rotor to a point substantially below the bottom ends of the slots 64m, namely, to a level as indicated by dot-dash lines 73 in FIG. 3**, further enhances the outward flow through the slots of the stator.

A slurry of large solids, such as kernels of corn in water, can be introduced into the vessel 24 by charging port 26 to immerse the grinding assembly 22 as shown in FIG. 1. The rotor 70 driven by motor 38 induces circulation of the slurry in the vessel 24. The large solids fall and/or are carried in the circulating fluid to below the lower edge of the skirt 69 and are pumped, together with water, upwardly through skirt 69 by pumping action of the rotor 70 to be introduced through the slots 75 between the rotor blades 76 to enter the slots 64 (64L, 64m) in the stator 54 and to be shearingly ground between the outer leading edges of blades 76 and the opposed inner edges of the stator slots 64.

As the large solid particles are ground while suspended in the liquid to form a slurry of particles of reduced size, additional large solid particles and liquid can be added to the interior of the vessel 24, and, as the level of fluids in the vessel 24 rises, the liquid level controller 30 can be actuated to open the outlet valve 28 and release part of the slurry to maintain the level of fluids in the vessel 24.

When it is desired to prepare slurries having a predetermined maximum size particle, i.e., slurries having particles of a particular size or smaller, a classifier screen 58 may be placed about the grinder 22 as shown in FIG. 1 so that particles larger than the desired maximum size are retained by the screen 58 in the volume of slurry recirculating therein through the grinder assembly 22 for regrinding, while the slurry containing particles no larger than the maximum desired size may pass through the classifier 58 in currents created by the grinding assembly 22, and be drawn off through the bottom drain 57 of the vessel 24 as shown in FIG. 1. Grain or other solids to be ground may be top added to the contents of the classifier 58 and water or other fluids may be top added directly to the contents of the classifier 58 through charging port 26.

The size or sizes of the stator slots relate both to the initial particle size of the material to be ground and to the maximum size of the particles desired to be produced through grinding. For example, if whole grain corn is to be ground having kernels of a maximum or length dimension of $\frac{5}{8}''$, an average or width dimension of $\frac{1}{2}''$, and a minimum or thickness dimension of $\frac{1}{4}''$, slots of $\frac{1}{4}''$ width dimension may be provided in at least one row of slots in the stator, that width being the minimum dimension of particles to be ground. If all of the slots in the row or rows of slots in the stator are of that size, as illustrated in FIG. 1, the kernels will be ground and reground effecting a continuing reduction in the maximum and other size particles in a given charge. However, as the size of the particles becomes smaller, they can in the slurry more readily pass through the grinder without undergoing further size reduction with the result that for a given size slot, there is what may be termed a diminishing return in particle size reduction as grinding and regrinding continues through slots of a given size. Accordingly, a given size stator slot is more efficient in grinding particles having a minimum dimension near the width of the slot and of lesser efficiency as that particle dimension is decreased through a range extending downwardly from the width of the slot. Thus, if a limited amount of reduction in particle size of feed material is desired and the desired size reduction is one which can be efficiently accomplished through use of stator slots of one size, then a stator having a plurality of rows of like size slots (as illustrated in FIG. 1, for example) may be used to effect that reduction by grinding. However, if greater size reduction is desired through the use of a single grinding assembly, then one row of slots of like size selected in relation to the minimum dimension of the particles of the feed stock to be ground is provided in row 65A adjacent the upper end of the stator (viz., $\frac{1}{4}''$ slots for corn as mentioned above), and a subjacent row 65B of slots of smaller width, viz. $\frac{1}{8}''$ width, is provided in the stator as well, as is illustrated in the stator shown in FIGS. 2, 3, 5 and 6. If the whole grain corn mentioned above is to be ground, the initial grinding of the kernels is effected through the wide slots in row 65A (FIG. 2), while the grinding of $\frac{1}{8}''$ and smaller particles will be more efficiently effected by the narrower and more numerous stator slots in row 65B (FIG. 2). The greater the reduction in particle size, the more end product particles a starting particle must be converted to, viz. a $\frac{1}{4}''$ cube converted to $\frac{1}{8}''$ cubes would yield eight pieces, but converted to 1/16" cubes would yield sixty-four pieces. Thus, for any specific operating grinding assembly the through-put in pounds of corn per unit of time decreases as the reduction in particle size is increased.

Thus, where the particle size reduction desired is greater than can be efficiently accomplished by a grinder assembly having a given stator, such as the stator having one or more rows of slots of one size as illustrated in FIG. 1, or one row of slots of one size and a second row of slots of smaller size but greater in number, as illustrated in FIGS. 2, 3 and 6, can efficiently accomplish, one or more additional grinding machine heads may be included in the system to effect the reduction of particle size beyond that which can be efficiently accomplished by the first grinding machine. FIG>7 illustrates such a system. The first grinding machine 201, which can grind through-put to an intermediate product having a predetermined maximum particle size, for use as a feed stock or part of a feed stock for a second grinding machine 202, that produces product having a maximum particle size less than that produced by grinding machine 201 and of desired size for end product or as feed stock for further processing.

The grinding machine 201 is similar to the grinding machine 20 of FIG. 1, the grinder assembly 221 having a stator 541, similar to stator 54 illustrated in FIGS. 2, 3 and 6, in which the slots in the upper row are larger but fewer in number and the slots in the lower row are smaller but greater in number. Also, the liquid and particles may be charged into grinding machine 201, either through the charging port 261 or through eductor 861, or the charting of machine 201 can be via both the charting port 261 and the eductor 861; that is, both particulate matter to be ground and the liquid in which it is to be ground may be charged, either one after the other, or as a pre-mix through charging port 261 or through eductor 861, or the liquid may be charged through either the charging port 261 or the eductor 861 while the particulate is charged through the other charging means, eductor 861 or charging port 261, with the charging of the liquid or the mixture of liquid and particulate being under operator or automatic control. As the grinding machine 201 operates, as when grinding assembly 221 is grinding corn in water as above described, the particles which will pass through the classifier 851 may move through the classifier into the portion of vessel 841 which is outside classifier 851. Separation of solids by settlement from the slurry in the upper portion of the vessel 841 laterally of the ported portion of classifier 851 is precluded by substantial stirring currents generated by operation of the grinding assembly 221. However, the bottom of the classifier 851 is an unported pan-like portion 95 which, being unported, results in the portion of the interior of the vessel 841 laterally and downwardly of pan 95 being substantially protected from stirring by the currents produced through operation of grinding assembly 221. As particles may tend in varying degrees to settle out of the slurry unless sufficient flow of the slurry through the bottom drain 871 is maintained, a transfer pump 89 is connected by drain line 90 to the bottom drain 871 and discharge from the pump 89 returned through line 92 and branch line 91 (containing flow restricting orifice 93) to the vessel 841. Operation of pump 89 circulates slurry from bottom drain 871 through line 90, pump 89, discharge line 92 and branch line 91 having flow restricting orifice 93 to the interior of vessel 841 outside classifier 851 to stir slurry outside and below pan 95, to continuously maintain the slurry in mixed condition. Pump discharge line 92 also extends beyond branch line 91 to transfer control valve 97.

As the discharge from grinding machine 201 produces an intermediate grind product, before that product is charged into grinding machine 202, it is often the case that the product is modified by adding to it additives which will result in the output from grinding machine 202 having more desirable properties. For example, it may be desirable to adjust the pH of the product of grinding machine 201, which would involve the addition of acid, or caustic, or it may be desirble to add yeast, or sulfur dioxide, or enzymes, or a combination of such or other additives, so that the product discharged from grinding machine 202 will have the desired properties for the intended further use; for example, as a feed stock to a process wherein such output is useful.

Accordingly, in FIG. 7 three additive containers with appropriate control valving and piping are shown connected to transfer pipeline 92 downstream of transfer control valve 97. The additive containers 102, 106 and 110 respectively contain additives 961, 962 and 963, and respectively discharge through discharge pipes 104, 108 and 112 containing respective control valves 103, 107 and 111, into additive feed line 105 through which they are fed into transfer line 92 between control valve 97 and eductor tube 862.

Control valve 97 in branch line 92 can be adjusted to regulate flow such that all of the output from bottom drain 871 of grinding machine 201 circulates through drain line 90, pump 89, transfer line 92 and branch line 91 back to the vessel 841 of machine 201 when valve 97 is closed. In the opposite limit condition, when valve 97 is open, a portion of the output from drain 871 passes through drain line 90, pump 89, transfer line 92 (including the open control valve 97 therein), to the input eductor tube 862 of grinding machine 202.

The operation of grinding machine 202 is similar to that of the grinding machine 201 upstream thereof. However, the grinding assembly 222 differs from that of assembly 221 in that the slots 692 in the stator 542 thereof are narrower and more numerous than the slots 691 in the stator of grinding assembly 221. As mentioned in the earlier illustrative comments concerning slot size, where used in grinding particulate feed of desired size, the slots in row 65A of grinder assembly 221 could have a width of ¼" and the slots in row 65B could be of a width of ⅛". Since the grinder assembly 222 is to produce further reduction of particle size, the slots in rows A and B of grinding assembly 222 could be a width of 1/16", with the result that as the slot size decreases the number of slots of each given size increases so as to provide the increased capacity for the increased numbers of particle reductions needed to effect reduction to particles of desired end size in volume related to through-put rate in an efficient manner.

The addition of additives as desired in the process of transfer from grinding machine 201 to grinding machine 202 as described above results in mixing of the additive materials and fluid being transferred, beginning when the additives are introduced into the flow of fluid undergoing transfer in line 92. The mixing continues as same move through the eductor 862 and mix additionally with the slurry flowing in skirt 692 to grinding assembly 222 where the additive or additives are subjected to further violent mixing with the slurry, which results in attainment of substantially homogenous distribution of the additives at the stator outlet within classifier 852. Other additives may be introduced through charging port 262, if desired.

As in the case of grinding machine 201, grinding machine 202 is also provided with a drain line 100 receiving through-put of grinding machine 202 from drain 872 to transfer pump 99, from which the through-put is discharged through transfer line 98 to output control valve 82. A branch line 101 connects transfer line 98 to the interior of vessel 842 outwardly of classifier 852. A flow restricting orifice 83 is provided in branch line 101. Thus, when output control valve 82 is closed, operation of pump 99 effects recirculation of through-put from the drain 872 of grinding machine 202 through line 100, pump 99, line 98, branch line 101, flow restricter 83, back into vessel 842. Also, when valve 82 is open, operation of pump 99 effects transfer of through-put from drain 872 of grinding machine 202 through drain line 100, pump 99, transfer line 98 and valve 82 to the desired receiver of the output.

While two grinding machines 201, 202 are shown in series in FIG. 7, additional grinding machines may be added if further particle size reduction is desired, or if greater through-put volume is desired. Also, by adjusting the material feed rates and transfer rates, contiuous production of slurry of desired composition, fineness of particle size and evenness of mixing can be obtained.

The wet grinding machine illustrated in the drawings and described above is subject to structural modification without departing from the spirit and scope of the appended claims.

Having described our invention, what we claim as new and desire to secure by letters patent is:

1. A wet grinding machine which includes a grinder head, an annular stator including an annular body portion mounted on the grinder head adjacent one of its ends and a skirt portion at the other of its ends, a rotor rotatably mounted on the grinder head, the rotor including an annular body portion inside of the annular stator and joined to a hub at one end of the rotor body portion, there being outwardly extending slots in the body portion of the rotor defining shearing blades in the body portion of the rotor and there being outwardly extending shearing slots in the body portion of the stator opposed to the shearing blades, each of the shearing slots sloping and overlapping at least one adjacent shearing blade whereby, as the rotor turns, each of the blades is constantly opposed to and addressing at least one of the shearing slots, there being an inlet opening in the stator skirt, there being an inlet opening in the rotor and means for turning the rotor to cause the rotor blades to induce a slurry to flow through the inlet openings of the stator skirt and rotor to the shearing slots and to shear particles of slurry entering the shearing slots.

2. A wet grinding machine as in claim 1 in which the inlet opening in the stator is in the skirt remote from the hub of the rotor.

3. A wet grinding machine as in claim 1 with a vessel in which the machine is mounted and from which contents are drawn through the inlet opening.

4. A combination as in claim 3 in which the stator slots extend outwardly and upwardly to discharge into fluid in the vessel.

5. A wet grinding machine as in claim 1 in which a suction tube cooperates with the skirt of the stator and extends away from the body of the stator to an inlet end of the suction tube at a selected location remote from the stator, whereby slurry from said selected location may be ground.

6. The combination of a wet grinding machine as in claim 5 in which an inlet port is provided in the suction tube wall, an eductor tube in communication with the port in the suction tube wall for delivering matter to the suction tube to be mixed with slurry flowing through the suction tube in response to rotation of the rotor, whereby the slurry flowing through the suction tube and the matter flowing through the eductor tube into the suction tube are mixed to form a slurry which is further mixed by the rotor and subjected to further shearing of slurry particles entering the shearing slots to produce a substantially homogeneous slurry.

7. A wet grinding machine as in claim 1 in which a classifier retains slurry particles larger than a predetermined size in slurry for regarding by the grinder head and permits slurry particles smaller than a predetermined size to pass beyond the classifier whereby a slurry containing particles smaller than a predetermined size may be produced by the grinding machine.

8. A wet grinding machine as in claim 1 in which the slots in the rotor body are arranged in a row extending annularly of the rotor body and are of equal length in the direction of the axis of rotor rotation, the shearing slots in the body portion of the stator having a dimension along the axis of rotor rotation equal to the dimension of the rotor slots along the axis of rotation of the rotor and the skirt of the stator extends upstream of slurry movement into the grinder a distance sufficient to substantially preclude eddy flow of slurry flowing from the shearing slots eddywise to the inlet opening.

9. A wet grinding machine as in claim 8 in which the slots in the rotor body are of equal size and arranged in a row extending annularly of the rotor body and are of equal length in the direction of the axis of rotor rotation, the shearing slots in the body portion of the stator are of equal size and have a dimension along the axis of rotor rotation in the surface of the stator body adjacent the rotor body less than the dimension of the slots in the rotor body, the ends of the slots in the adjacent surfaces of the stator body and the rotor body remote from the inlet end of the stator and inlet end of the rotor lie substantially in a radial plane of the axis of rotor rotation and the ends of the slots in the rotor nearest the inlet of the rotor extend upstream of the ends of the stator slots, whereby the rotor slots in the external surface of the rotor address an unslotted portion of the stator body to enhance flow of slurry through the stator slots.

10. A wet grinding machine as in claim 1 in which a grinder head having stator slots of a size to produce a predetermined particle size reduction with optimum efficiency is provided with a classifier through which particles no larger than the predetermined size may pass to a second classifier which will contain paticles of a size greater than those of further predetermined reduction in size, a second grinder for grinding slurry retained by the second classifier and having a row of stator slots of greater number and reduced size to produce a predetermined further particle size reduction with greater efficiency to the particle size which may pass through the second classifier, whereby reduction in particle size of a slurry may be effected with efficiency.

11. A wet grinding machine as in claim 10 in which slurry which has passed through the first classifier is introduced through an eductor into the suction tube of the second grinding head, whereby the slurry entering the inlet of the second grinding head is a substantially homogeneous composition of graded particle sizes.

12. A wet grinding machine as in claim 11 in which additional ingredients may be added to the slurry in the eductor as the slurry passes from the first classifier to the second grinding head, whereby additional ingredients may be added to the slurry and rapidly dispersed in substantially homogeneous fashion in the slurry as it exits from the second grinder head.

13. A wet grinding machine as in claim 1 in which a grinder head having stator slots of a size to produce a predetermined particle size reduction with optimum efficiency is provided with a classifier through which particles smaller than the predetermined size may pass to a second classifier which will contain particles of a size greater than those of further predetermined reduction in size, a second grinder for grinding slurry retained by the second classifier and having a row of stator slots of greater number and reduced size related to the range of particle sizes in the second classifier to produce a predetermined further particle size reduction with greater efficiency to the particle size which may pass through the second classifier, whereby reduction in particle size of a slurry may be effected with efficiency.

14. A wet grinding machine as in claim 1 in which a grinder head having stator slots of a size to produce a predetermined particle size reduction with optimum efficiency is provided with a classifier through which particles smaller than the predetermined size may pass to a second classifier which will contain particles of a size greater than those of a further predetermined reduction in size, a second grinder for grinding slurry retained by the second classifier and having a plurality of rows of stator slots, the like slots in one row being of a size and related number to with greater efficiency reduce the size of particles of the larger sizes in the second classifer and the like slots in a second row being of a smaller size and greater number to with greater efficiency reduce the size of particles of smaller sizes retained in the second classifier to produce a predetermined further particle size reduction with greater efficiency to the particle size which may pass through the second classifier, whereby reduction in particle size of a slurry may be effected with efficiency.

15. A wet grinding machine which includes a grinder head, an annular stator including an annular body portion mounted on the grinder head adjacent one of its ends, a rotor rotatably mounted on the grinder head, the rotor including an annular body portion inside of the annular stator and joined to a hub at one end of the rotor body portion and to an annular skirt at the opposite end of the rotor, there being outwardly extending slots in the body portion of the rotor defining shearing blades in the body portion of the rotor and there being outwardly extending shearing slots in the body portion of the stator opposed to the shearing blades, each of the shearing slots sloping and overlapping at least one adjacent shearing blade whereby, as the rotor turns, each of the blades is constantly opposed to and addressing at least one of the shearing slots, there being an inlet opening in the stator, there being an inlet opening in the rotor skirt and means for turning the rotor to cause the rotor blades to induce a slurry to flow through the inlet openings of the stator and rotor skirt to the shearing slots and to shear particles of slurry entering the shearing slots.

16. A wet grinding machine as in claim 15 with a vessel in which the machine is mounted and from which contents are drawn through the inlet opening.

17. A wet grinding machine as in claim 16 in which the stator slots extend outwardly and upwardly to discharge into fluid in the vessel.

18. A wet grinding machine as in claim 15 in which a suction tube cooperates with the skirt of the stator and extends away from the body of the stator to an inlet end of the suction tube at a selected location remote from the stator, whereby slurry from said selected location may be ground.

19. The combination of a wet grinding machine as in claim 18 in which an inlet port is provided in the suction tube wall, an eductor tube in communication with the port in the suction tube wall for delivering matter in the suction tube to be mixed with slurry flowing through the suction tube in response to rotation of the rotor, whereby the slurry flowing through the suction tube and the matter flowing through the eductor tube into the suction tube are mixed to form a slurry which is further mixed by the rotor and subjected to further shearing of slurry particles entering the shearing slots to produce a substantially homogeneous slurry.

20. A wet grinding machine as in claim 15 in which a classifier retains slurry particles larger than a predetermined size in slurry for regrinding by the grinder head and permits slurry particles smaller than a predetermined size to pass beyond the classifier whereby a slurry containing particles smaller than a predetermined size may be produced by the grinding machine.

21. A wet grinding machine as in claim 15 in which the slots in the rotor body are arranged in a row extending annularly of the rotor body and are of equal length in the direction of the axis of rotor rotation, the shearing slots in the body portion of the stator having a dimension along the axis of rotor rotation equal to the dimension of the rotor slots along the axis of rotation of the rotor and the skirt of the stator extends upstream of slurry movement into the grinder a distance sufficient to substantially preclude eddy flow of slurry flowing from the shearing slots eddywise to the inlet opening.

22. A wet grinding machine as in claim 21 in which the slots in the rotor body are of equal size and arranged in a row extending annularly of the rotor body and are of equal length in the direction of the axis of rotor rotation, the shearing slots in the body portion of the stator are of equal size and have a dimension along the axis of rotor rotaiton in the surface of the stator body adjacent the rotor body less than the dimension of the slots in the rotor body, the ends of the slots in the adjacent surfaces of the stator body and the rotor body remote from the inlet end of the stator and inlet end of the rotor lie substantially in a radial plane of the axis of rotor rotation and the ends of the slots in the rotor nearest the inlet of the rotor extend upstream of the ends of the stator slots, whereby the rotor slots in the external surface of the rotor address an unslotted portion of the stator body to enhance flow of slurry through the stator slots.

23. A wet grinding machine as in claim 15 in which a grinder head having stator slots of a size to produce a predetermined particle size reduction with optimum efficiency is provided with a classifier through which particles no larger than the predetermined size may pass to a second classifier which will contain particles of a size greater than those of further predetermined reduction in size, a second grinder for grinding slurry retained by the second classifier and having stator slots of greater and reduced size to produce a predetermined further particle size reduction with greater efficiency to the particle size which may pass through the second classifier, whereby reduction in particle size of a slurry may be effected with efficiency.

24. A wet grinding machine as in claim 23 in which slurry which has passed through the first classifier is introduced through an eductor into the suction tube of the second grinding head, whereby the slurry entering the inlet of the second grinding head is a substantially homogeneous composition of graded particle sizes.

25. A wet grinding machine as in claim 24 in which additional ingredients may be added to the slurry in the eductor as the slurry passes from the first classifier to the second grinding head, whereby additional ingredients may be added to the slurry and rapidly dispersed in substantially homogeneous fashion in the slurry as it exits from the second grinder head.

26. A wet grinding machine as in claim 15 in which a grinder head having stator slots of a size to produce a predetermined particle size reduction with optimum efficiency is provided with a classifier through which particles smaller than the predetermined size may pass to a second classifier which will contain particles of a size greater than those of further predetermined reduction in size, a second grinder for grinding slurry retained by the second classifier and having a row of stator slots of greater number and reduced size related to the range of particle sizes in the second classifier to produce a predetermined further particle size reduction with greater efficiency to the particle size which may pass through the second classifier, whereby reduction in particle size of a slurry may be effected with efficiency.

27. A wet grinding machine as in claim 15 in which a grinder head having stator slots of a size to produce a predetermined particle size reduction with optimum efficiency is provided with a classifier through which particles smaller than the predetermined size may pass to a second classifier which will contain particles of a size greater than those of a further predetermined reduction in size, a second grinder for grinding slurry retained by the second classifier and having a plurality of rows of stator slots, the like slots in one row being of a size and related number to with greater efficiency reduce the size of particles of the larger sizes in the second classifier and the like slots in a second row being of a smaller size and greater number to with greater efficiency reduce the size of particles of smaller sizes retained in the second classifier to produce a predetermined further particle size reduction with greater efficiency to the particle size which may pass through the second classifier, whereby reduction in particle size of a slurry may be effected with efficiency.

28. A wet grinding machine which includes a grinder head, an annular stator including an annular body portion mounted on the grinder head adjacent one of its ends and a skirt portion at the other of its ends, a rotor rotatably mounted on the grinder head, the rotor including an annular body portion inside of the annular stator and joined to a hub at one end of the rotor body portion and to an annular skirt at the inlet end of the body portion, there being outwardly extending slots in the body portion of the rotor defining shearing blades in the body portion of the rotor between the hub and skirt portions thereof and there being outwardly extending shearing slots in the body portion of the stator opposed to the shearing blades, each of the shearing slots sloping and overlapping at least one adjacent shearing blade whereby as the rotor turns, each of the blades is constantly opposed to and addressing at least one of the shearing slots, there being an inlet opening in the stator skirt, there being an inlet opening in the rotor skirt and means for turning the rotor to cause the rotor blades to induce a slurry to flow through the inlet openings of the stator skirt and rotor skirt to the shearing slots and to shear particles of slurry entering the shearing slots.

29. A wet grinding machine as in claim 28 in which the inlet opening in the stator is in the skirt remote from the hub of the rotor.

30. A wet grinding machine as in claim 28 with a vessel in which the machine is mounted and from which contents are drawn through the inlet opening.

31. A wet grinding machine as in claim 30 in which the stator slots extend outwardly and upwardly to discharge into fluid in the vessel.

32. A wet grinding machine as in claim 28 in which a suction tube cooperates with the skirt of the stator and extends away from the body of the stator to an inlet end of the suction tube at a selected location remote from the stator, whereby slurry from said selected location may be ground.

33. The combination of a wet grinding machine as in claim 32 in which an inlet port is provided in the suction tube wall, an eductor tube in communication with the port in the suction tube wall for delivering matter to the suction tube to be mixed with slurry flowing through the suction tube in response to rotation of the rotor, whereby the slurry flowing through the suction tube and the matter flowing through the eductor tube into the suction tube are mixed to form a slurry which is further mixed by the rotor and subjected to further shearing of slurry particles entering the shearing slots to produce a substantially homogeneous slurry.

34. A wet grinding machine as in claim 28 in which a classifier retains slurry particles larger than a predetermined size in slurry for regrinding by the grinder head and permits slurry particles smaller than a predetermined size to pass beyond the classifier whereby a slurry containing particles smaller than a predetermined size may be produced by the grinding machine.

35. A wet grinding machine as in claim 28 in which the slots in the rotor body are arranged in a row extending annularly of the rotor body and are of equal length in the direction of the axis of rotor rotation, the shearing slots in the body portion of the stator having a dimension along the axis of rotor rotation equal to the dimension of the rotor slots along the axis of rotation of the rotor and the skirt of the stator extends upstream of slurry movement into the grinder a distance sufficient to substantially preclude eddy flow of slurry flowing from the shearing slots eddywise to the inlet opening.

36. A wet grinding machine as in claim 35 in which the slots in the rotor body are of equal size and arranged in a row extending annularly of the rotor body and are of equal length in the direction of the axis of rotor rotation, the shearing slots in the body portion of the stator are of equal size and have a dimension along the axis of rotor roation in the surface of the stator body adjacent the rotor body less than the dimension of the slots in the rotor body, the ends of the slots in the adjacent surfaces of the stator body and the rotor body remote from the inlet end of the stator and inlet end of the rotor lie substantially in a radial plane of the axis of rotor rotation and the ends of the slots in the rotor nearest the inlet of the rotor extend upstream of the ends of the stator slots, whereby the rotor slots in the external surface of the rotor address an unslotted portion of the stator body to enhance flow of slurry through the stator slots.

37. A wet grinding machine as in claim 28 in which a grinder head having stator slots of a size to produce a predetermined particle size reduction with optimum efficiency is provided with a classifier through which particles no larger than the predetermined size may pass to a second classifier which will contain particles of a size greater than those of further predetermined reduction in size, a second grinder for grinding slurry retained by the second classifier and having stator slots of greater number and reduced size to produce a predetermined further particle size reduction with greater efficiency to the particle size which may pass through the second classifier, whereby reduction in particle size of a slurry may be effected with efficiency.

38. A wet grinding machine as in claim 37 in which slurry which has passed through the first classifier is introduced through an eductor into the suction tube of the second grinding head, whereby the slurry entering the inlet of the second grinding head is a substantially homogeneous composition of graded particle sizes.

39. A wet grinding machine as in claim 38 in which additional ingredients may be added to the slurry in the eductor as the slurry passes from the first classifier to the second grinding head, whereby additional ingredients may be added to the slurry and rapidly dispersed in substantially homogeneous fashion in the slurry as it exits from the second grinder head.

40. A wet grinding machine as in claim 28 in which a grinder head having stator slots of a size to produce a predetermined particle size reduction with optimum efficiency is provided with a classifier through which particles smaller than the predetermined size may pass to a second classifier which will contain particles of a size greater than those of further predetermined reduction in size, a second grinder for grinding slurry retained by the second classifer and having a row of stator slots of greater number and reduced size related to the range of particle sizes in the second classifier to produce a predetermined further particle size reduction with greater efficiency to the particle size which may pass through the second classifier, whereby reduction in particle size of a slurry may be effected with efficiency.

41. A wet grinding machine as in claim 28 in which a grinder head having stator slots of a size to produce a predetermined particle size reduction with optimum efficiency is provided with a classifier through which particles smaller than the predetermined size may pass to a second classifier which will contain particles of a size greater than those of a further predetermined reduction in size, a second grinder for grinding slurry retained by the second classifer and having a plurality of rows of stator slots, the like slots in one row being of a size and related number to with greater efficiency reduce the size of particles of the larger sizes in the second classifier and the like slots in a second row being of a smaller size and greater number to with greater efficiency reduce the size of particles of smaller sizes retained in the second classifier to produce a predetermined further particle size reduction with greater efficiency to the particle size which may pass through the second classifier, whereby reduction in particle size of a slurry may be effected with efficiency.

* * * * *

UNITED STATES PATENT AND TRADEMARK OFFICE

CERTIFICATE OF CORRECTION

PATENT NO. : 4,813,617

DATED : March 21, 1989

INVENTOR(S) : Arthur C. Knox, Jr. and Anthony Witsken

It is certified that error appears in the above-identified patent and that said Letters Patent is hereby corrected as shown below:

Column 10, line 13, "regarding" should be - - regrinding - -;

Column 12, line 43, "rotaiton" should be - - rotation - -;

Column 14, line 55, "roation" should be - - rotation - -.

Signed and Sealed this

Twenty-second Day of August, 1989

*Attest:*

*Attesting Officer*

DONALD J. QUIGG

*Commissioner of Patents and Trademarks*